US009273844B2

(12) United States Patent
Matsumoto

(10) Patent No.: US 9,273,844 B2
(45) Date of Patent: Mar. 1, 2016

(54) VEHICULAR LAMP

(71) Applicant: KOITO MANUFACTURING CO., LTD., Minato-ku, Tokyo (JP)

(72) Inventor: Akinori Matsumoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/280,089

(22) Filed: May 16, 2014

(65) Prior Publication Data

US 2014/0340924 A1 Nov. 20, 2014

(30) Foreign Application Priority Data

May 17, 2013 (JP) ..... 2013-104666

(51) Int. Cl.
*F21S 8/10* (2006.01)

(52) U.S. Cl.
CPC ..... *F21S 48/1388* (2013.01); *F21S 48/1159* (2013.01); *F21S 48/1778* (2013.01)

(58) Field of Classification Search
CPC F21S 48/1388; F21S 48/1778; F21S 48/1159
USPC ..... 362/538, 539
See application file for complete search history.

(56) References Cited

U.S. PATENT DOCUMENTS

| | | | | |
|---|---|---|---|---|
| 2002/0071286 | A1* | 6/2002 | Taniuchi | 362/514 |
| 2002/0085387 | A1* | 7/2002 | Taniuchi | 362/538 |
| 2012/0014125 | A1* | 1/2012 | Uchida | 362/538 |
| 2012/0113665 | A1* | 5/2012 | Matsumoto | 362/518 |

FOREIGN PATENT DOCUMENTS

| | | | |
|---|---|---|---|
| JP | 2003-338209 | A | 11/2003 |
| JP | 2012-190551 | A | 10/2012 |

* cited by examiner

*Primary Examiner* — Laura Tso
(74) *Attorney, Agent, or Firm* — Sughrue Mion, PLLC

(57) ABSTRACT

A vehicular lamp includes: a projection lens; a light source arranged to a rear of a rear side focal point of the projection lens; a reflector that reflects light from the light source toward the projection lens; a cut-off forming member arranged between the light source and the projection lens; a first sub-reflector that is arranged in front of the reflector and reflects the light from the light source rearward; and a second sub-reflector that is arranged to the rear of the rear side focal point and reflects reflected light from the first sub-reflector toward the projection lens.

15 Claims, 9 Drawing Sheets

VEHICULAR LAMP

INCORPORATION BY REFERENCE

The disclosure of Japanese Patent Application No. 2013-104666 filed on May 17, 2013 including the specification, drawings and abstract is incorporated herein by reference in its entirety.

BACKGROUND OF THE INVENTION

1. Field of the Invention

The invention relates to vehicular lamp including a cut-off forming member.

2. Description of Related Art

Typically, a projector type vehicular lamp forms a light distribution pattern by invertedly projecting a light source image formed on a rear side focal plane of a projection lens forward.

Also, when forming a light distribution pattern having a cut-off line at an upper end portion, such as a low-beam distribution pattern, by radiated light from such a vehicular lamp, a cut-off forming member such as a shade is arranged between a light source and a projection lens.

Japanese Patent Application Publication No. 2003-338209 (JP 2003-338209 A) describes such a projection type vehicular lamp having a configuration in which a first sub-reflector that reflects light from a light source downward, and a second sub-reflector that reflects the reflected light from this first sub-reflector forward so that it passes through a lower space of the projection lens, are both arranged in front of a reflector that reflects light from the light source toward a projection lens.

Meanwhile, Japanese Patent Application Publication No. 2012-190551 (JP 2012-190551 A) describes such a projection type vehicular lamp having a configuration in which a sub-reflector that retroreflects light from a light source so that it returns to the position of the light source is arranged in front of a reflector that reflects light from the light source toward a projection lens. In this vehicular lamp, the retroreflected light from the sub-reflector is reflected by a surface of the light source (more specifically, a light-emitting device) so that it strikes the reflector again, and this reflected light from the reflector is re-reflected toward the projection lens.

By employing the lamp configuration described in JP 2003-338209 A, an additional light distribution pattern formed by the light from the light source that has been sequentially reflected by the first and second sub-reflectors is added to the light distribution pattern formed by emitted light from the projection lens, thereby enabling the brightness of the light distribution pattern to be reinforced.

However, when this kind of configuration is employed, the size in the vertical direction of the overall lamp ends up increasing due to the presence of the first and second sub-reflectors, so the lamp may not be able to be made compact.

On the other hand, by employing the lamp configuration described in JP 2012-190551 A, the brightness of the light distribution pattern is able to be reinforced while making the lamp compact.

However, when this kind of configuration is employed, the retroreflected light from the sub-reflector is first reflected by the surface of the light source, and then re-reflected by the reflector, so the degree of freedom in the formation position and shape of the additional light distribution pattern formed by this re-reflected light decreases. Therefore, it is difficult to effectively reinforce the brightness of the light distribution pattern.

SUMMARY OF THE INVENTION

The invention thus provides a projector type vehicular lamp including a cut-off forming member, in which an additional light distribution pattern that can effectively reinforce the brightness of a light distribution pattern is able to be formed by a compact lamp configuration.

A first aspect of the invention relates to a vehicular lamp that includes a projection lens; a light source arranged to a rear of a rear side focal point of the projection lens; a reflector that reflects light from the light source toward the projection lens; a cut-off forming member arranged between the light source and the projection lens; a first sub-reflector that is arranged in front of the reflector and reflects the light from the light source rearward; and a second sub-reflector that is arranged to the rear of the rear side focal point and reflects reflected light from the first sub-reflector toward the projection lens.

According to this configuration, in a projector type vehicular lamp that is provided with a cut-off forming member, an additional light distribution pattern that can effectively reinforce the brightness of a light distribution pattern is able to be formed by a compact lamp configuration.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will be described with reference to the accompanying drawings.

Figure 1:
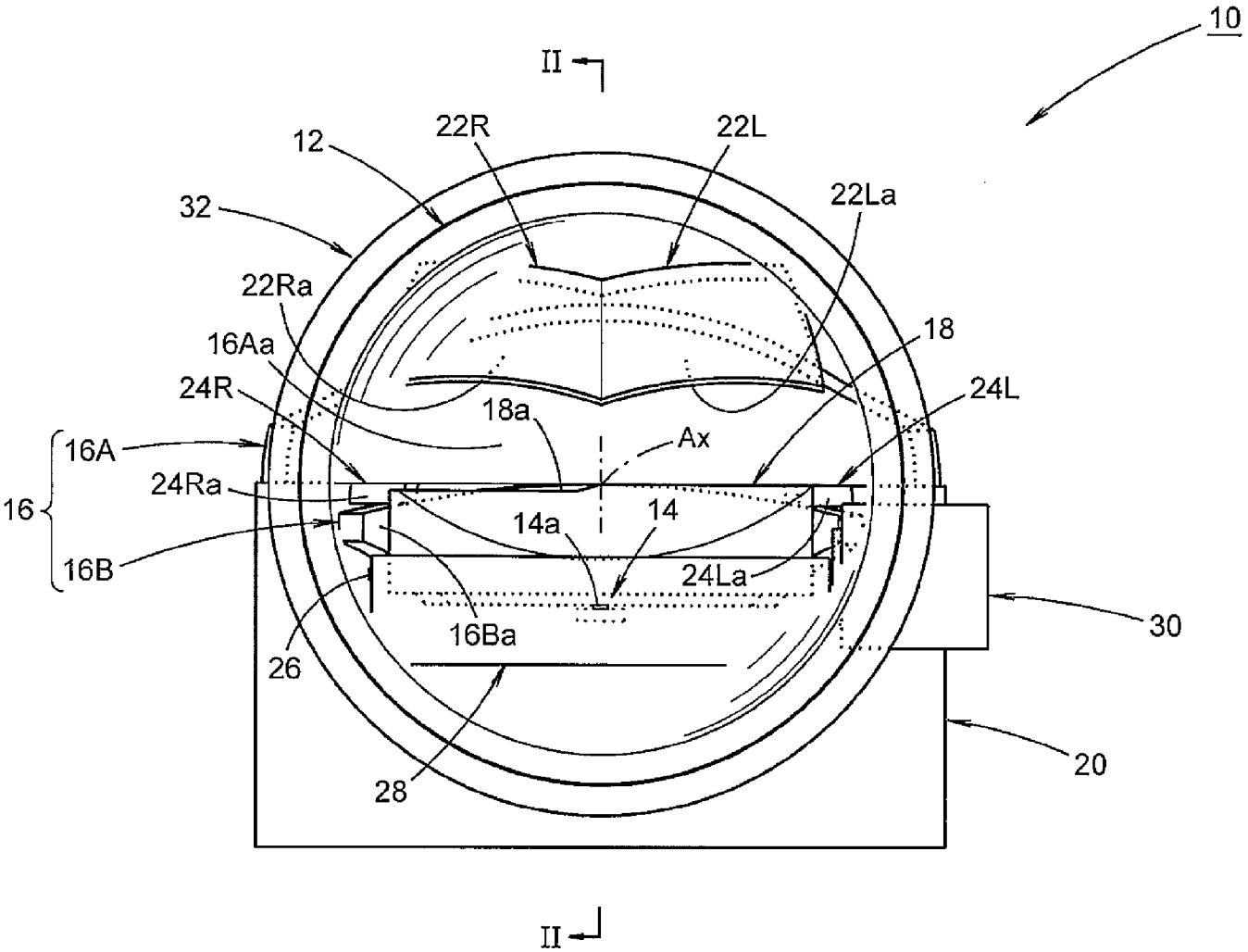
FIG. 1 is a front view of a vehicular lamp according to one example embodiment of the invention.
Figure 2:
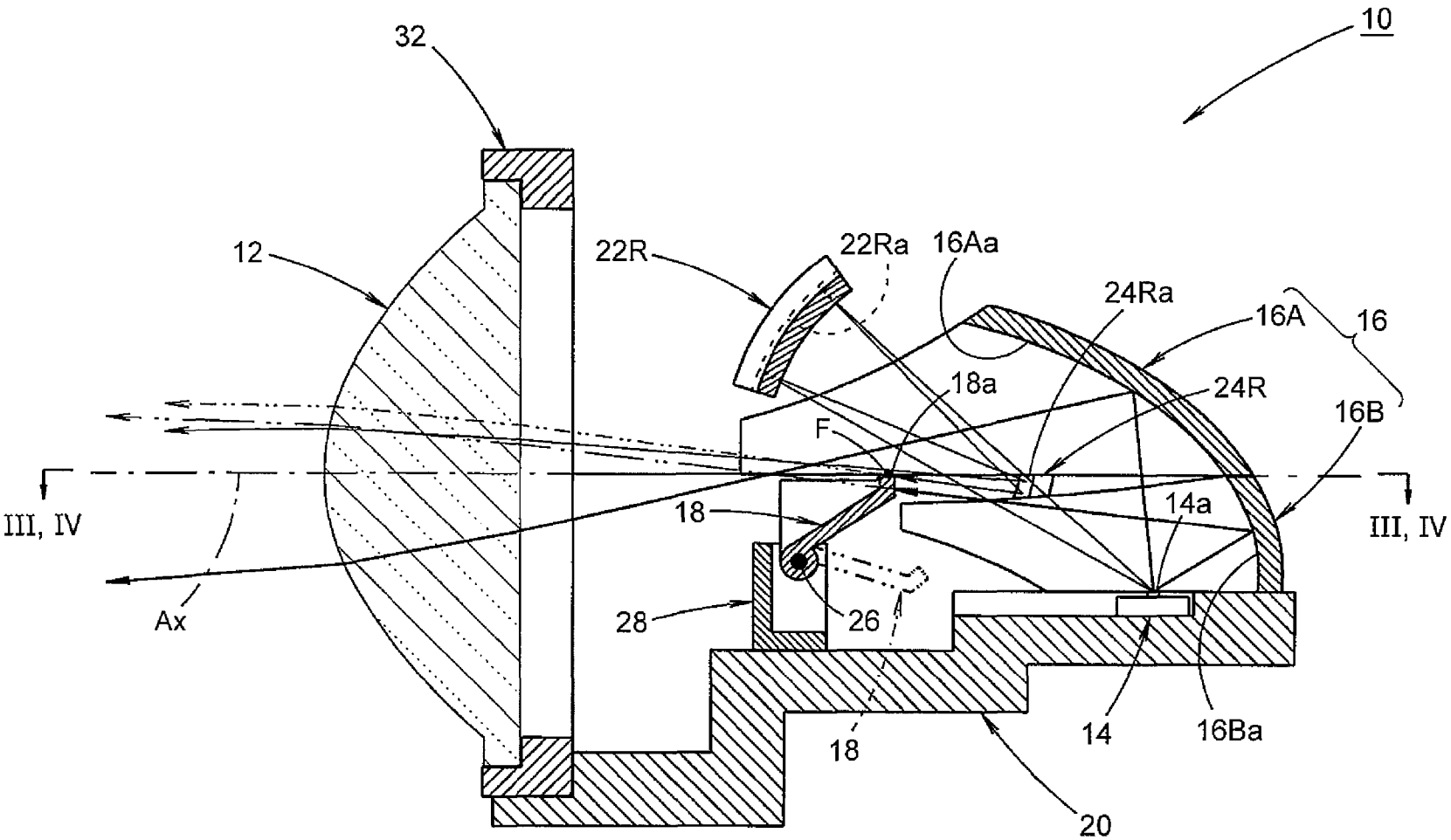
FIG. 2 is a sectional view taken along line II-II in FIG. 1.
Figure 3:
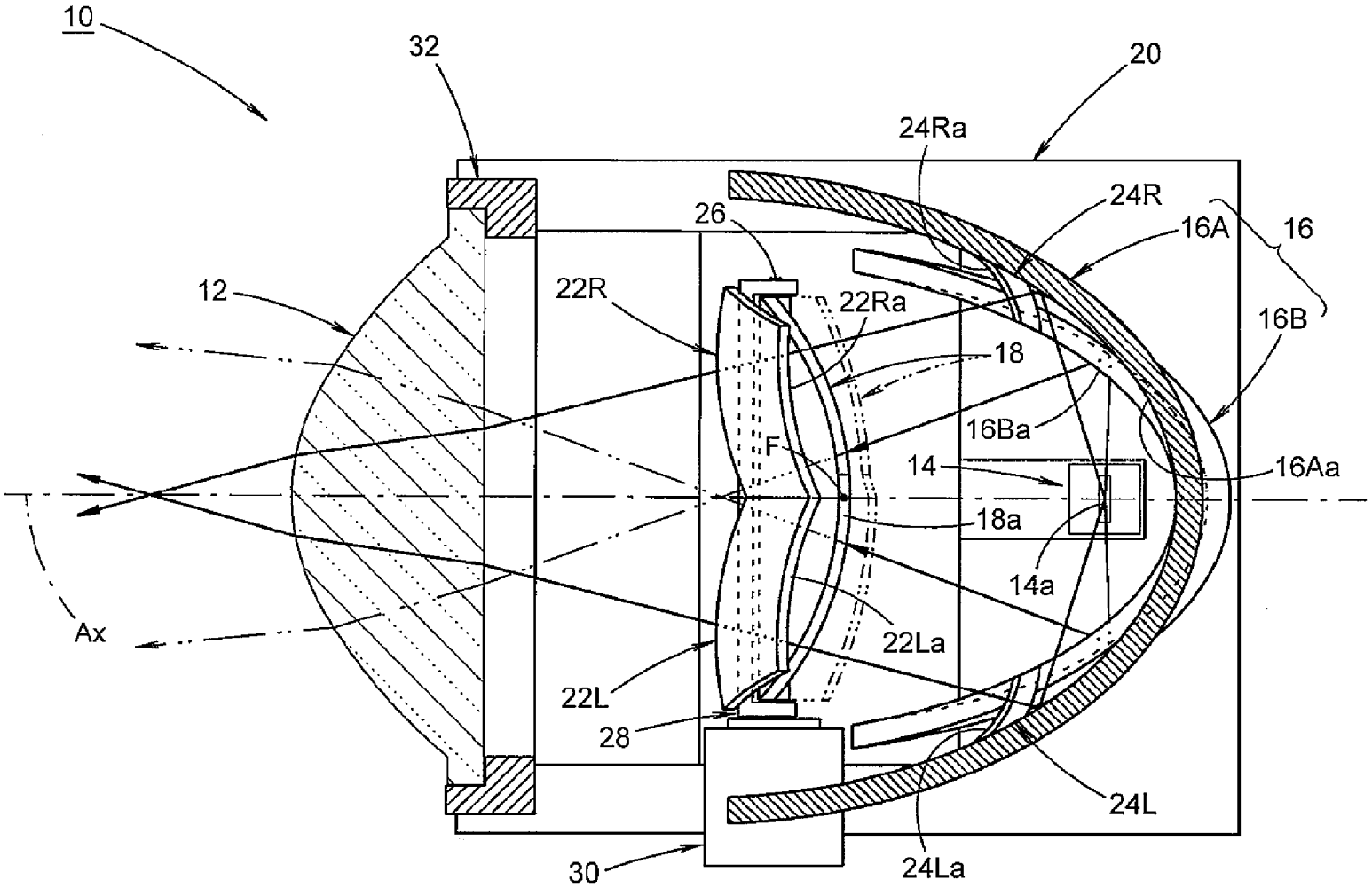
FIG. 3 is a sectional view (part 1) taken along line III, IV-III, IV in FIG. 2.
Figure 4:
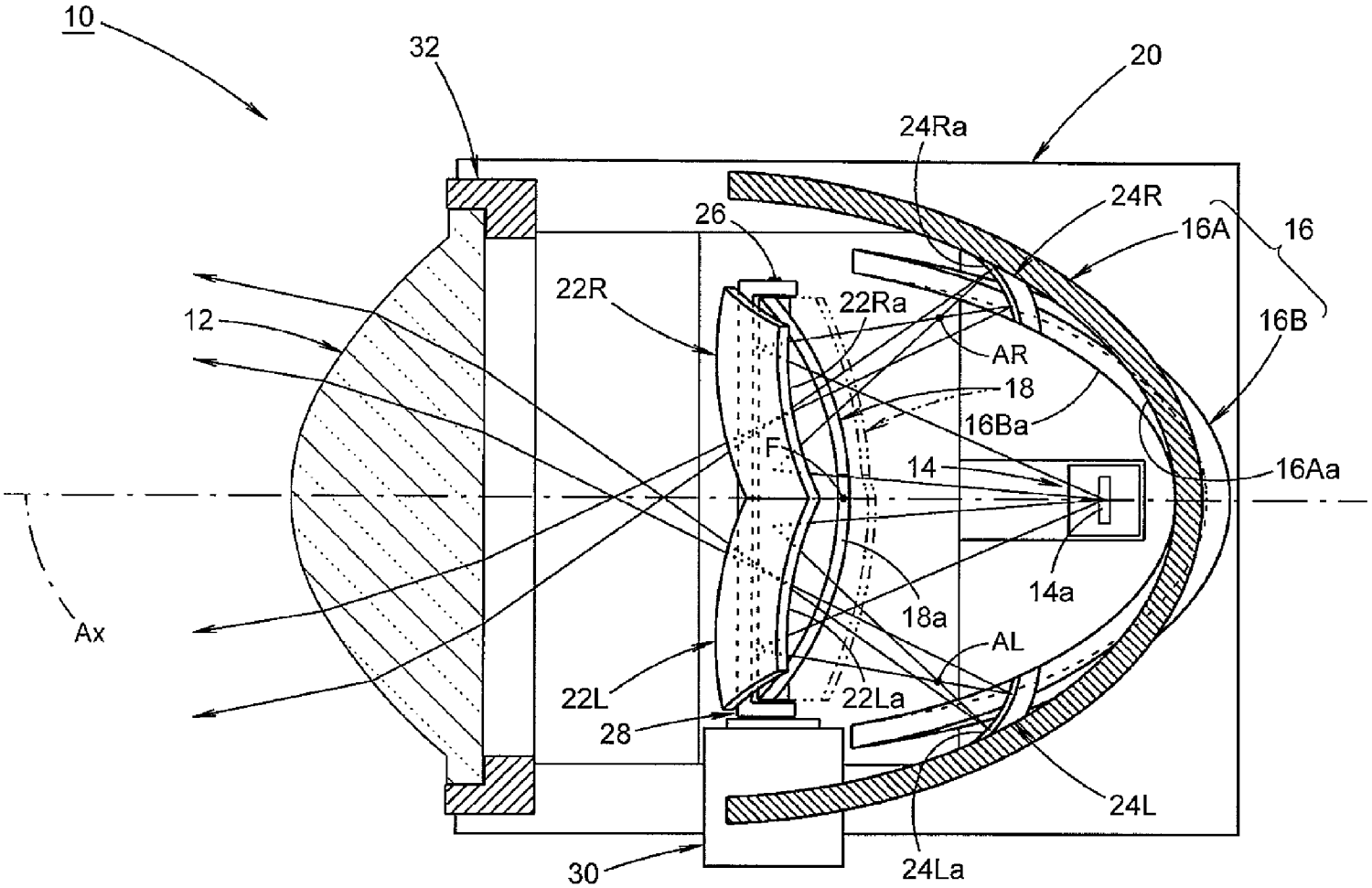
FIG. 4 is a sectional view (part 2) taken along line III, IV-III, IV in FIG. 2.
Figure 5:
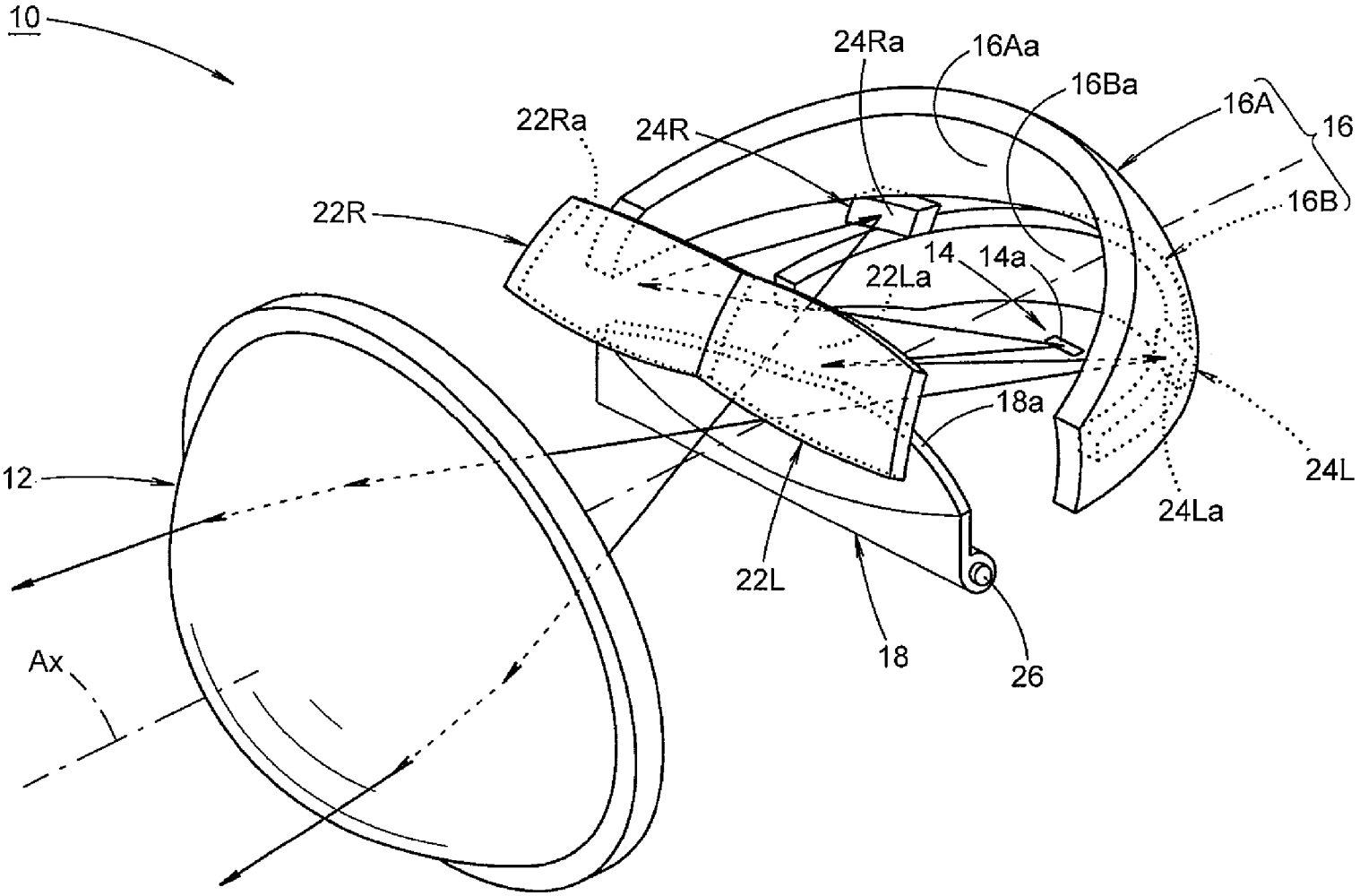
FIG. 5 is a perspective view of the main constituent elements of the vehicular lamp.

FIG. 1 is a front view of a vehicular lamp 10 according to one example embodiment of the invention, and FIG. 2 is a sectional view taken along line II-II in FIG. 1. Also, FIGS. 3 and 4 are sectional views taken along line III, IV-III, IV in FIG. 2, and FIG. 5 is a perspective view of the main constituent elements of the vehicular lamp 10.

As shown in these drawings, the vehicular lamp 10 according to this example embodiment includes a projection lens 12, a light-emitting device 14 arranged to the rear of (behind) a rear side focal point F of this projection lens 12, a reflector 16 that is arranged so as to cover this light-emitting device 14 from above, and that reflects light from the light-emitting device 14 toward the projection lens 12, a movable shade 18 arranged between the light-emitting device 14 and the projection lens 12, and first sub-reflectors 22L and 22R and second sub-reflectors 24L and 24R.

This vehicular lamp 10 is a lamp unit used in a state incorporated in a headlamp, as a portion of the headlamp. When incorporated in the headlamp, a light axis Ax of the projection lens 12 is arranged inclined downward approximately 0.5 to 0.6° from horizontal, extending in the longitudinal direction of a vehicle.

The projection lens 12 is a planoconvex aspherical lens in which a front surface is a convex surface and a rear surface is a flat surface. This projection lens 12 projects a light source image formed on a rear side focal plane that is a focal plane that includes the rear side focal point F, onto a virtual vertical screen in front of the lamp as an inverted image. This projection lens 12 is supported at an outer peripheral flange portion thereof by a lens holder 32. Also, this lens holder 32 is supported by a base member 20.

The light-emitting device 14 is a white light-emitting diode, and has a horizontally oblong light-emitting surface 14*a*. This light-emitting device 14 is arranged with the light-emitting surface 14*a* facing up, below the light axis Ax. This light-emitting device 14 is supported by the base member 20.

The reflector 16 includes an upper reflector 16A positioned above a horizontal plane that includes the light axis Ax, and a lower reflector 16B positioned below the horizontal plane that includes the light axis Ax. As long as the reflector is configured to reflect light from the light source toward the projection lens, the specific arrangement and the reflective surface shape and the like thereof are not particularly limited.

A reflective surface 16Aa of the upper reflector 16A is formed by a curved surface that forms a portion of a surface of an ellipsoid in which the center of light emission of the light-emitting device 14 coincides with a first focal point.

A vertical sectional shape along a long axis of this reflective surface 16Aa forms a portion of an ellipsoid in which a point positioned slightly in front of the rear side focal point F coincides with a second focal point. Also, the eccentricity of the ellipsoid that forms a section of the reflective surface 16Aa is set to become gradually larger from a vertical section toward a horizontal section. Accordingly, the upper reflector 16A makes the light from the light-emitting device 14 converge on a point positioned slightly in front of the rear side focal point F in the vertical section, and makes the light from the light-emitting device 14 converge on a point quite far in front of the converging position in the vertical section, in the horizontal section.

A reflective surface 16Ba of the lower reflector 16B is formed by a curved surface that forms a portion of a surface of an ellipsoid in which the center of light emission of the light-emitting device 14 coincides with a first focal point.

A vertical sectional shape along a long axis of this reflective surface 16Ba forms a portion of an ellipsoid in which a point positioned slightly in front of the rear side focal point F coincides with a second focal point. Also, the eccentricity of the ellipsoid that forms a section of the reflective surface 16Ba is set to become gradually larger from a vertical section toward a horizontal section. However, an amount of increase in the eccentricity from the vertical section toward the horizontal section is set to a smaller value than it is with the reflective surface 16Aa of the upper reflector 16A. Accordingly, the lower reflector 16B makes the light from the light-emitting device 14 converge on a point positioned slightly in front of the rear side focal point F in the vertical section, and makes the light from the light-emitting device 14 converge on a point somewhat in front of the converging position in the vertical section, in the horizontal section.

The reflective surface 16Aa of the upper reflector 16A and the reflective surface 16Ba of the lower reflector 16B are formed by a continuous curved line in a vertical plane that includes the light axis Ax. Also, the upper reflector 16A and the lower reflector 16B are assembled in a state abutting against each another in a horizontal plane that includes the light axis Ax.

A lower end surface of the upper reflector 16A is formed extending along the horizontal plane that includes the light axis Ax (the lower end surface of the upper reflector 16A is positioned on a horizontal plane that includes the light axis Ax). Meanwhile, an upper end surface of the lower reflector 16B is formed with a rear end portion thereof positioned on a horizontal plane that includes the light axis Ax, and extends at an angle downward toward left and right front end portions from this rear end portion.

The lower reflector 16B is supported at a lower end surface thereof by the base member 20. Also, the upper reflector 16A is supported at a lower end surface of both left and right end portions thereof by the base member 20.

The movable shade 18 is pivotally supported by a shade holder 28 via a pivot pin 26 that extends in the lateral direction, below the light axis Ax. This shade holder 28 is supported by the base member 20. The pivot pin 26 is positioned on a front end portion of the movable shade 18. The movable shade 18 is formed extending at an angle upward from the front end portion thereof rearward. An upper end edge 18*a* of the movable shade 18 is formed laterally uneven.

Also, this movable shade 18 is able to be placed in a shading position (i.e., a position indicated by the solid line in FIGS. 2 and 3), and a non-shading position (i.e., a position indicated by the two-dotted broken line in FIGS. 2 and 3) in which the movable shade 18 has been pivoted downward by a predetermined angle from the shading position, by an actuator 30 that is supported by the base member 20. This actuator 30 is driven when a beam switching switch, not shown, is operated.

When in the shading position, the movable shade 18 is arranged such that the upper end edge 18*a* that is laterally uneven passes through the rear side focal point F of the projection lens 12 and extends in the horizontal direction, and consequently shades some of the light from the light-emitting device 14 that has been reflected by the reflector 16. On the other hand, when in the non-shading position, this upper end edge 18*a* is displaced somewhat lower than the rear side focal point F of the projection lens 12, and consequently does not shade the light from the light-emitting device 14 that has been reflected by the reflector 16.

The first sub-reflectors 22L and 22R are arranged in front of the reflector 16, and are configured to reflect the light from the light-emitting device 14 rearward. On the other hand, the second sub-reflectors 24L and 24R are arranged to the rear of the rear side focal point F of the projection lens 12, and are configured to reflect the reflected light from the first sub-reflectors 22L and 22R toward the projection lens 12.

These first sub-reflectors 22L and 22R and second sub-reflectors 24L and 24R are arranged in pairs on both the left and right sides of the light axis Ax. Also, these first sub-reflectors 22L and 22R and second sub-reflectors 24L and 24R are configured such that the second sub-reflector 24L on the left side reflects the reflected light from the first sub-reflector 22L on the left side, and the second sub-reflector 24R on the right side reflects the reflected light from the first sub-reflector 22R on the right side.

Light paths of the reflected light of the upper reflector 16A and the lower reflector 16B are shown in FIG. 3, and light paths of the twice reflected light of the first sub-reflectors 22L and 22R and the second sub-reflectors 24L and 24R are shown in FIG. 4.

The pair of first sub-reflectors 22L and 22R are arranged in a bilaterally symmetrical positional relationship adjacent to each other sandwiching a vertical plane that includes the light axis Ax. Each reflective surface 22La and 22Ra of these first sub-reflectors 22L and 22R is formed as a portion of the surface of an ellipsoid, and converges light from the center of light emission of the light-emitting device 14 at points AL and AR positioned near the front of the second sub-reflectors 24L and 24R. These first sub-reflectors 22L and 22R are each supported by the base member 20 via a support member, not shown.

Meanwhile, the pair of second sub-reflectors 24L and 24R are arranged in a bilaterally symmetrical positional relationship in a positions away from the light axis Ax, on both the left and right sides. Each reflective surface 24La and 24Ra of these second sub-reflectors 24L and 24R is formed as a portion of the surface of an ellipsoid, and converges light from the center of light emission of the light-emitting device 14 that has been reflected by the second sub-reflectors 24L and 24R (i.e., the light that has converged at the points AL and AR) at positions away from the light axis Ax, on the both the left and right sides, somewhat in front of the upper end edge 18*a* of the movable shade 18.

These second sub-reflectors 24L and 24R are arranged between the upper end surface of the lower reflector 1613 and the lower end surface of the upper reflector 16A. These second sub-reflectors 24L and 24R are formed by integrated molding with the lower reflector 16B.

Figure 6A:
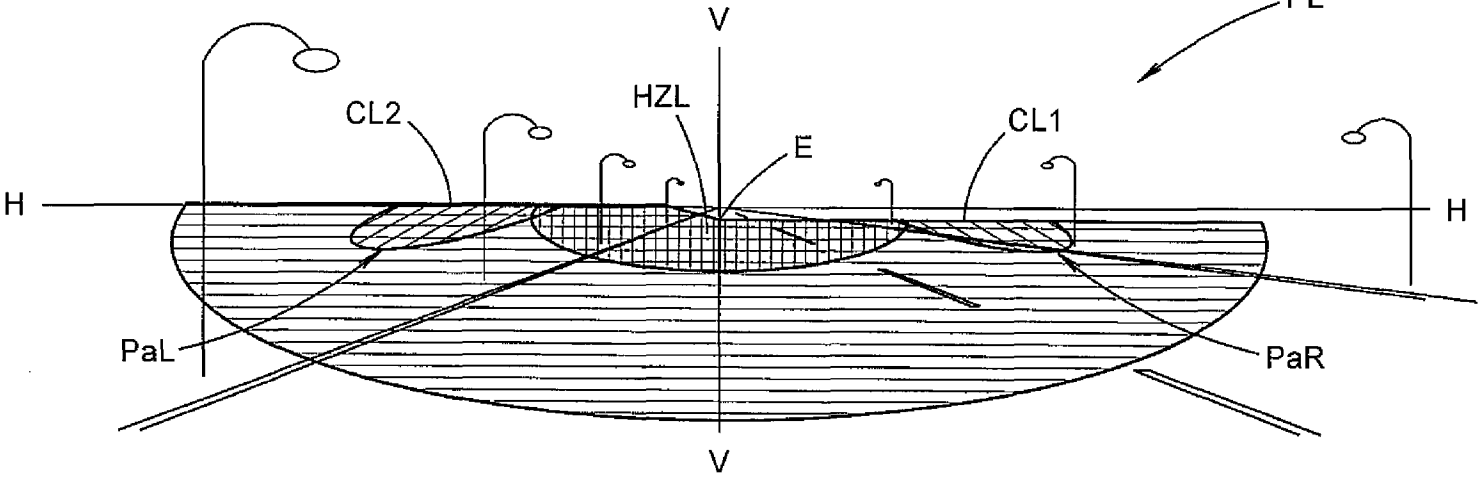
FIGS. 6A and 6B are transparent views of light distribution patterns formed on a virtual vertical screen arranged in a position 25 meters in front of a vehicle, by light radiated forward from the vehicular lamp.
Figure 6B:
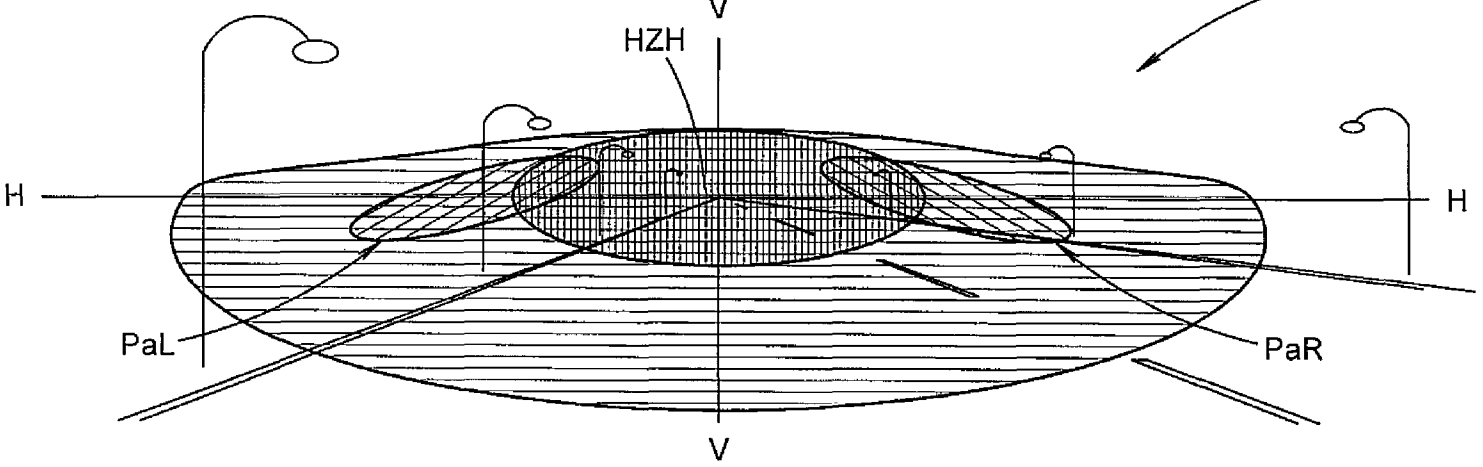

FIGS. 6A and 6B are transparent views of light distribution patterns formed on a virtual vertical screen arranged in a position 25 meters in front of the vehicular lamp 10, by light radiated forward from the vehicular lamp 10. FIG. 6A is a view of a low beam distribution pattern PL, and FIG. 6B is a view of a high beam distribution pattern PH.

The low beam distribution pattern PL is formed when the movable shade 18 is in the shading position, while the high beam distribution pattern PH is formed when the movable shade 18 is in the non-shading position.

The low beam distribution pattern PL shown in FIG. 6A is a low beam distribution pattern of left light distribution, and has cut-off lines CL1 and CL2 that are laterally uneven at an upper end edge thereof. These cut-off lines CL1 and CL2 extend in the horizontal direction with a line V-V that passes vertically through H-V that is a vanishing point in the front direction of the lamp. The cut-off line CL2 is positioned above the cut-off line CL1. An opposite lane-side portion on the right side of the line V-V is formed as the lower cut-off line CL1, and a host vehicle lane-side portion on the left side of the line V-V is formed as the upper cut-off line CL2 that rises from this lower cut-off line CL1 via an inclined portion.

This low beam distribution pattern PL is formed by projecting, as an inverted projection image on the virtual vertical screen by the projection lens 12, a light source image of the light-emitting device 14 formed on the rear side focal plane of the projection lens 12 by light from the light-emitting device 14 that has been reflected by the reflector 16. The cut-off lines CL1 and CL2 of this low beam distribution pattern PL are formed as an inverted projection image of the upper end edge 18*a* of the movable shade 18.

In this low beam distribution pattern PL, an elbow point E that is the point of intersection of the lower cut-off line CL1 and the line V-V is positioned approximately 0.5 to 0.6° below H-V. This is because the light axis Ax extends in a downward direction approximately 0.5 to 0.6° with respect to the vehicle longitudinal direction. Also, in this low beam distribution pattern PL, a high-intensity zone (i.e., a hot zone) HZL is formed around the elbow point E.

In this low beam distribution pattern PL, a pair of additional light distribution patterns PaL and PaR are additionally formed one on each of the left and right sides of this high-intensity zone HZL (this will be described later).

Meanwhile, at the upper end of the high beam distribution pattern PH shown in FIG. 6B, the reflected light from the reflector 16 is not shaded by the movable shade 18, so the upper end of the high beam distribution pattern PH extends above the cut-off lines CL1 and CL2 of the low beam distribution pattern PL.

In this high beam distribution pattern PH, a high-intensity zone HZH is formed centered around H-V. The majority of the high-intensity zone HZH is formed by reflected light from the lower reflector 16B that has high condensing degree.

In this high beam distribution pattern PH, the pair of additional light distribution patterns PaL and PaR are additional formed one on each of the left and right sides of this high-intensity zone HZH.

The additional light distribution pattern PaL on the left side is a light distribution pattern formed by light from the light-emitting device 14 that has been sequentially reflected by the first sub-reflector 22R on the right side and the second sub-reflector 24R on the right side. This additional light distribution pattern PaL on the left side is formed vertically straddling line H-H that passes horizontally through H-V, and partially overlapping with a left end portion of the high-intensity zone HZH.

On the other hand, the additional light distribution pattern PaR on the right side is a light distribution pattern formed by light from the light-emitting device 14 that has been sequentially reflected by the first sub-reflector 22L on the left side and the second sub-reflector 24L on the left side. This additional light distribution pattern PaR on the right side is formed vertically straddling line H-H, and partially overlapping with a right end portion of the high-intensity zone HZH.

Also, with this high beam distribution pattern PH, the high-intensity zone HZH is extended on both the right and left sides by the pair of additional light distribution patterns PaL and PaR, so this high beam distribution pattern PH increases long distance side visibility.

With the low beam distribution pattern PL shown in FIG. 6A, the pair of additional light distribution patterns PaL and PaR are such that the upper portion is blocked by the cut-off lines CL1 and CL2, and only the lower portion is projected. Also, with this low beam distribution pattern PL as well, the high-intensity zone HZL is extended on both the left and right sides by the pair of additional light distribution patterns PaL and PaR, so this low beam distribution pattern PL increases long distance side visibility.

The operation and effects of this example embodiment will now be described.

The vehicular lamp 10 according to this example embodiment is formed as a projector type lamp that includes the movable shade 18 as a cut-off forming member. The first sub-reflectors 22L and 22R that reflect light from the light-emitting device 14 as a light source rearward are arranged in front of the reflector 16 of the vehicular lamp 10, and the second sub-reflectors 24L and 24R that reflect the reflected light from the first sub-reflectors 22L and 22R toward the projection lens 12 are arranged to the rear of the rear side focal point F of the projection lens 12. As a result, operation and effects such as those described below are able to be obtained.

Having the vehicular lamp 10 be configured such that the reflected light from the first sub-reflectors 22L and 22R is reflected toward the projection lens 12 by the second sub-reflectors 24L and 24R enables the first sub-reflectors 22L and 22R and the second sub-reflectors 24L and 24R to be used as special light controlling members for forming the additional light distribution patterns PaL and PaR. Therefore, the degree of freedom in the formation position of the additional light distribution patterns PaL and PaR or the size and shape thereof and the like is able to be increased, and as a result, the brightness of the low beam distribution pattern PL and the high beam distribution pattern PH is able to be effectively reinforced.

In this example embodiment, the vehicular lamp 10 is configured to emit the reflected light from the second sub-reflectors 24L and 24R forward via the projection lens 12, so the first sub-reflectors 22L and 22R and the second sub-reflectors 24L and 24R are able to be arranged in a compact layout.

In this way, according to this example embodiment, in the projector type vehicular lamp 10 that is provided with the cut-off forming member, the additional light distribution patterns PaL and PaR that can effectively reinforce the brightness of the low beam distribution pattern PL and the high beam distribution pattern PH are able to be formed by the compact lamp configuration.

In this example embodiment, the first sub-reflectors 22L and 22R and the second sub-reflectors 24L and 24R are arranged in pairs on both the left and right sides of the light axis Ax of the projection lens 12. Also, these first sub-reflectors 22L and 22R and the second sub-reflectors 24L and 24R are configured such that the second sub-reflector 24L on the left side reflects the reflected light from the first sub-reflector 22L on the left side, and the second sub-reflector 24R on the right side reflects the reflected light from the first sub-reflector 22R on the right side. As a result, operation and effects such as those described below are able to be obtained.

The reflected light from the second sub-reflectors 24L and 24R is able to efficiently reach the projection lens 12, and the additional light distribution patterns PaL and PaR are able to be formed in two locations, i.e., one on the left and one on the right. As a result, the brightness of the low beam distribution pattern PL and the high beam distribution pattern PH is able to be even more effectively reinforced.

Also, in this example embodiment, the movable shade 18 as a cut-off forming member is able to be placed in a shading position in which the movable shade 18 shades a portion of the reflected light from the reflector 16, and a non-shading position in which the movable shade 18 does not shade the portion of the reflected light from the reflector 16, so the brightness is able to be effectively reinforced in both the low beam distribution pattern PL and the high beam distribution pattern PH.

Furthermore, in this example embodiment, the reflector 16 includes the upper reflector 16A and the lower reflector 16B, so the reflective surface shapes of the upper reflector 16A and the lower reflector 16B are able to be easily set to shapes suitable for forming the low beam distribution pattern PL and the high beam distribution pattern PH.

Moreover, in this example embodiment, the second sub-reflectors 24L and 24R are formed by integrated molding with the lower reflector 16B. As a result, operation and effects such as those described below are able to be obtained.

That is, in order to increase the center luminous intensity of the high beam distribution pattern PH, the lower reflector 16B is configured to increase the condensing degree of this reflected light, and the lateral width of the lower reflector 16B is narrower than the lateral width of the upper reflector 16A. Therefore, the second sub-reflectors 24L and 24R are able to be easily formed by integrated molding with the lower reflector 16B. Also, employing this kind of structure makes it possible to provide the second sub-reflectors 24L and 24R while keeping the lamp configuration compact and suppressing an increase in the number of parts.

In the example embodiment described above, when the movable shade 18 is in the shading position, the upper end edge 18*a* thereof is arranged so as to pass through the rear side focal point F of the projection lens 12, but at this time, the upper end edge 18*a* of the movable shade 18 may also be arranged so as to pass near the rear side focal point F (for example, close above or close below the rear side focal point F).

In the example embodiment described above, the vehicular lamp 10 is configured to form the low beam distribution pattern PL of the left light distribution, but similar operation and effects may also be obtained by employing a structure similar to that described in the example embodiment when the vehicular lamp 10 is configured to form the low beam distribution pattern of a right light distribution, or configured to form a light distribution pattern having only a horizontal cut-off line at an upper end portion.

Next, a modified example of the foregoing example embodiment will be described.

Figure 7:
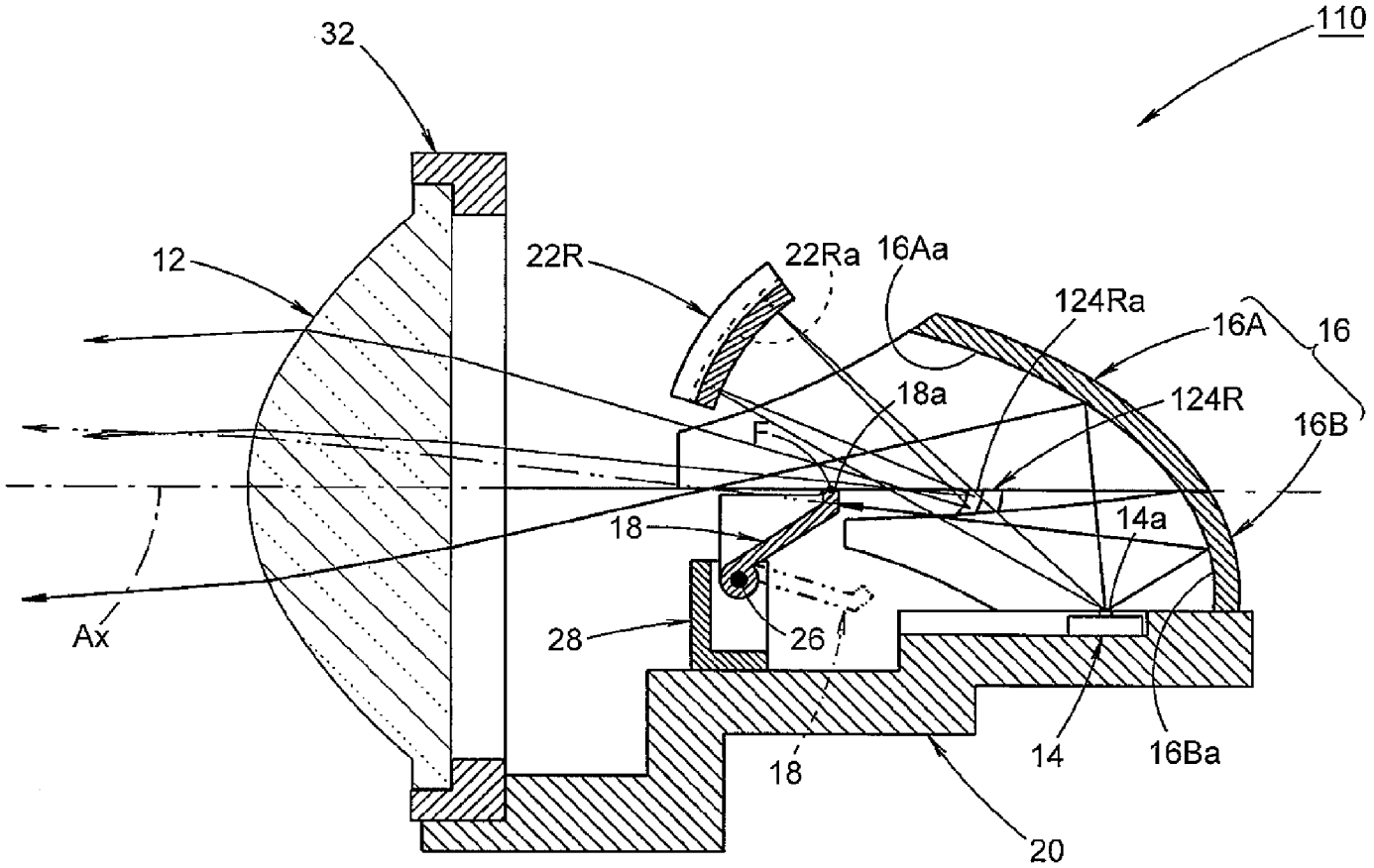
FIG. 7 is a view similar to FIG. 2, of a modified example of the example embodiment.
Figure 8:
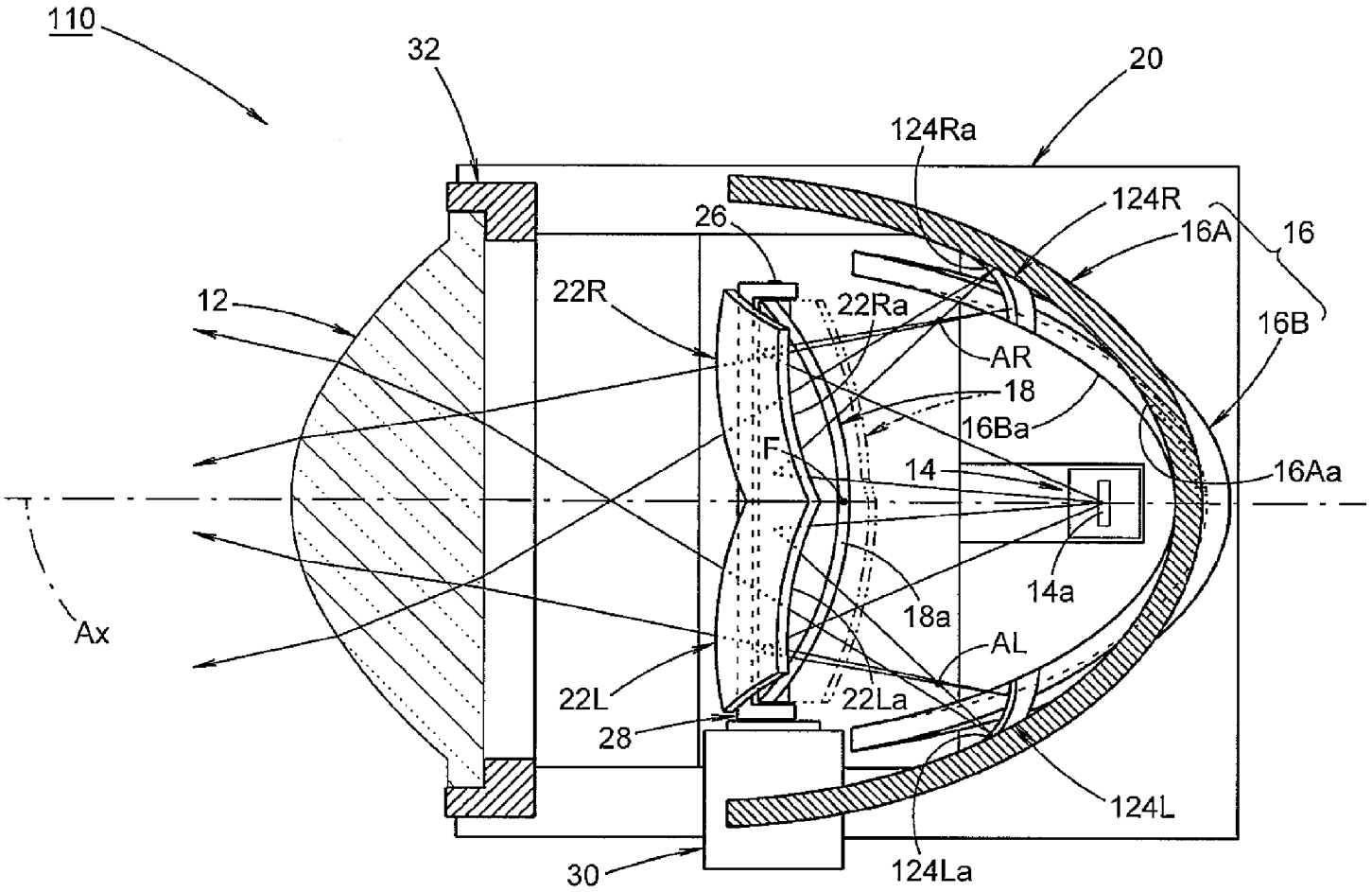
FIG. 8 is a view similar to FIG. 4, of the modified example.

FIGS. 7 and 8 are views similar to FIGS. 2 and 4, of a vehicular lamp 110 according to this modified example.

As shown in these drawings, the basic structure of the modified example is the same as that of the example embodiment described above, but the structure of a pair of second sub-reflectors 124L and 124R on both the left and right sides differs from that in the example embodiment described above.

That is, the second sub-reflectors 124L and 124R of this modified example are also arranged in substantially the same positions as the second sub-reflectors 24L and 24R of the example embodiment described above, and are configured such that the second sub-reflector 124L on the left side reflects the reflected light from the first sub-reflector 22L on the left side, and the second sub-reflector 124R on the right sides reflects the reflected light from the first sub-reflector 22R on the right side.

However, reflective surfaces 124La and 124Ra of the second sub-reflectors 124L and 124R reflect the reflected light from the first sub-reflectors 22L and 22R farther upward than the reflective surfaces 24La and 24Ra of the second sub-reflectors 24L and 24R of the example embodiment described above do, such that the reflected light passes between the movable shade 18 in the shading position and the first sub-reflectors 22L and 22R and reaches the projection lens 12.

Also, the reflective surfaces 124La and 124Ra of the second sub-reflectors 124L and 124R reflect the reflected light from the first sub-reflectors 22L and 22R at a larger diffusion angle than the reflective surfaces 24La and 24Ra of the second sub-reflectors 24L and 24R of the example embodiment described above do.

Figure 9A:
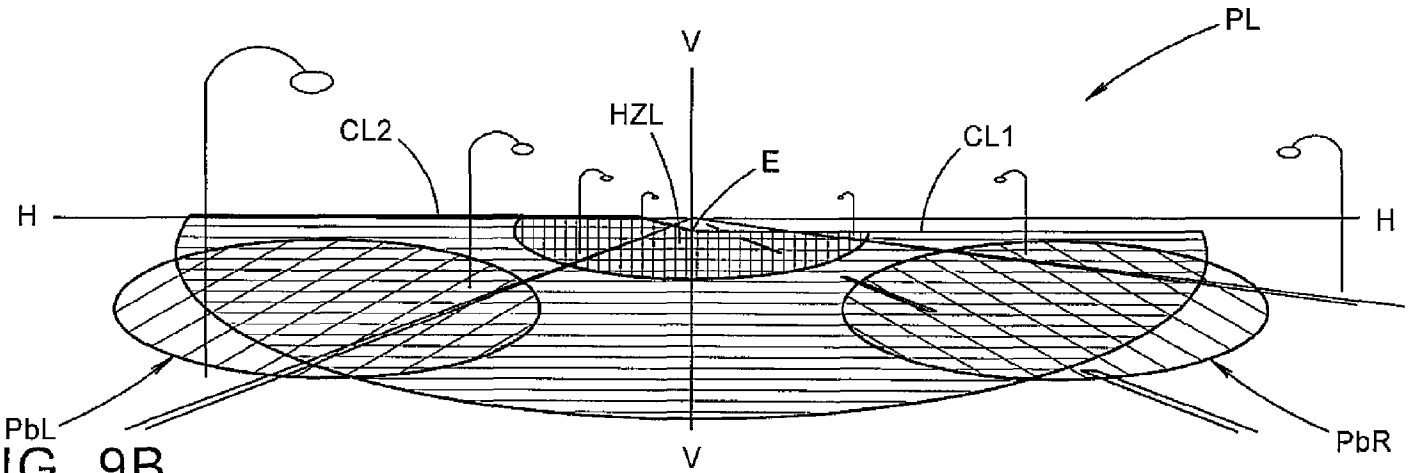
FIGS. 9A and 9B are views similar to FIG. 6, of the operation of the modified example.
Figure 9B:
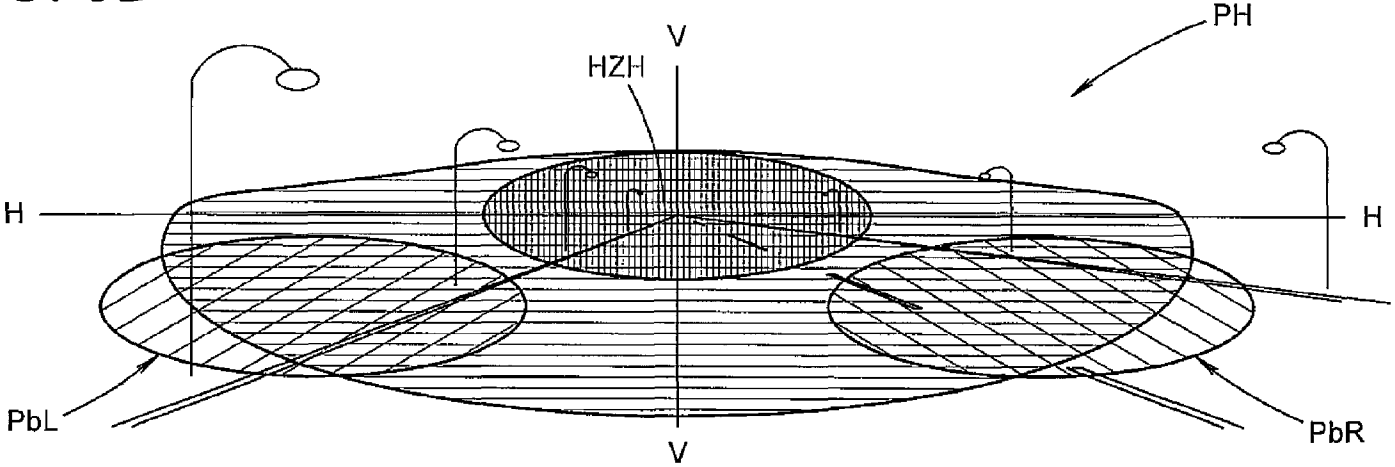

FIGS. 9A and 9B are transparent views similar to FIGS. 6A and 6B, of light distribution patterns formed on the virtual vertical screen by light radiated forward from the vehicular lamp 110.

With the low beam distribution pattern PL shown in FIG. 9A, a pair of additional light distribution patterns PbL and PbR are formed as light distribution patterns that extend relatively largely downward below the cut-off lines CL1 and CL2. As a result, the brightness of both left and right end portions of the low beam distribution pattern PL is reinforced, so the visibility of a shoulder portion of the road, in front of the vehicle, on which the vehicle is traveling is increased.

With the high beam distribution pattern PH shown in FIG. 9B as well, the visibility of a shoulder portion of the road, in front of the vehicle, on which the vehicle is traveling is increased.

When the configuration of the modified example is employed as well, the additional light distribution patterns PbL and PbR that can effectively reinforce the brightness of the low beam distribution pattern PL and the high beam distribution pattern PH are able to be formed by a compact lamp configuration.

Numerical values indicated in the example embodiment and the modified example thereof are only examples and may also be set to different values as appropriate.

Also, the invention is not limited to the structures described in the example embodiment and the modified example thereof. Various other modifications of these structures are also possible.

The kind of light source is not particularly limited, and may be a light bulb or a light-emitting device such as a light-emitting diode or a laser diode, for example.

The specific arrangement and reflective surface shape and the like of the reflector are not particularly limited as long as the reflector is configured to reflect light from the light source toward the projection lens.

The specific configuration of the cut-off forming member is not particularly limited as long as the cut-off forming member is a member capable of forming a cut-off line at an upper end portion of a light distribution pattern formed by reflected light from the reflector. For example, the cut-off forming member may be a shade or a mirror member having an upward-facing reflective surface or the like.

The specific arrangement and reflective surface shape and the like of the first sub-reflector are not particularly limited as long as the first sub-reflector is arranged in front of the reflector so as to reflect light from the light source rearward.

The specific arrangement and reflective surface shape and the like of the second sub-reflector are not particularly limited as long as the second sub-reflector is arranged so as to reflect the reflected light from the first sub-reflector toward the projection lens.

What is claimed is:

1. A vehicular lamp comprising:

a projection lens;

a light source arranged to a rear of a rear side focal point of the projection lens;

a reflector that reflects light from the light source toward the projection lens;

a cut-off forming member arranged between the light source and the projection lens;

a first sub-reflector that is arranged in front of the reflector and reflects the light from the light source rearward; and a second sub-reflector that is arranged to the rear of the rear side focal point and reflects reflected light from the first sub-reflector toward and through the projection lens.

2. The vehicular lamp according to claim 1, wherein the second sub-reflector is formed by integrated molding with the reflector.

3. The vehicular lamp according to claim 1, wherein:

the cut-off forming member is movable to a shading position and a non-shading position; and the cut-off forming member shades a portion of the reflected light from the reflector in the shading position, and does not shade the reflected light from the reflector in the non-shading position.

4. The vehicular lamp according to claim 3, wherein the reflector includes an upper reflector and a lower reflector.

5. The vehicular lamp according to claim 4, wherein the second sub-reflector is formed by integrated molding with the lower reflector.

6. The vehicular lamp according to claim 1, wherein:

the first sub-reflector is arranged one on each of left and right sides of a light axis of the projection lens, and the second sub-reflector is arranged one on each of the left and right sides of the light axis of the projection lens; and the second sub-reflector on the left side reflects reflected light from the first sub-reflector on the left side, and the second sub-reflector on the right side reflects reflected light from the first sub-reflector on the right side.

7. A vehicular lamp comprising:

a projection lens;

a light source arranged to a rear of a rear side focal point of the projection lens;

a reflector that reflects light from the light source toward the projection lens;

a cut-off forming member arranged between the light source and the projection lens;

a first sub-reflector that is arranged in front of the reflector and reflects the light from the light source rearward; and a second sub-reflector that is arranged to the rear of the rear side focal point and reflects reflected light from the first sub-reflector toward the projection lens;

wherein:

the first sub-reflector is arranged one on each of left and right sides of a light axis of the projection lens, and the second sub-reflector is arranged one on each of the left and right sides of the light axis of the projection lens; and the second sub-reflector on the left side reflects reflected light from the first sub-reflector on the left side, and the second sub-reflector on the right side reflects reflected light from the first sub-reflector on the right side;

the second sub-reflectors are arranged in positions away from the light axis of the projection lens, on both the left and right sides; and the second sub-reflector on the left side is arranged in a position where the second sub-reflector on the left side receives the reflected light from the first sub-reflector on the left side, and the second sub-reflector on the right side is arranged in a position where the second sub-reflector on the right side receives the reflected light from the first sub-reflector on the right side.

8. The vehicular lamp according to claim 7, wherein the second sub-reflector is formed by integrated molding with the reflector.

9. The vehicular lamp according to claim 7, wherein:

the cut-off forming member is movable to a shading position and a non-shading position; and the cut-off forming member shades a portion of the reflected light from the reflector in the shading position, and does not shade the reflected light from the reflector in the non-shading position.

10. The vehicular lamp according to claim 9, wherein the reflector includes an upper reflector and a lower reflector.

11. The vehicular lamp according to claim 10, wherein the second sub-reflector is formed by integrated molding with the lower reflector.

12. A vehicular lamp comprising:

a projection lens;

a light source arranged to a rear of a rear side focal point of the projection lens;

a reflector that reflects light from the light source toward the projection lens;

a cut-off forming member arranged between the light source and the projection lens;

a first sub-reflector that is arranged in front of the reflector and reflects the light from the light source rearward; and a second sub-reflector that is arranged to the rear of the rear side focal point and reflects reflected light from the first sub-reflector toward the projection lens; wherein the reflector includes an upper reflector positioned above a horizontal plane that includes a light axis of the projection lens and a lower reflector positioned below the horizontal plane that includes the light axis of the projection lens; and the second sub-reflector is arranged between an upper end surface of the lower reflector and a lower end surface of the upper reflector.

13. The vehicular lamp according to claim 12, wherein the second sub-reflector is formed by integrated molding with the reflector.

14. The vehicular lamp according to claim 12, wherein:

the cut-off forming member is movable to a shading position and a non-shading position; and the cut-off forming member shades a portion of the reflected light from the reflector in the shading position, and does not shade the reflected light from the reflector in the non-shading position.

15. The vehicular lamp according to claim 12, wherein:

the first sub-reflector is arranged one on each of left and right sides of a light axis of the projection lens, and the second sub-reflector is arranged one on each of the left and right sides of the light axis of the projection lens; and a the second sub-reflector on the left side reflects reflected light from the first sub-reflector on the left side, and the second sub-reflector on the right side reflects reflected light from the first sub-reflector on the right side.

* * * * *